United States Patent [19]

Bacon, Jr.

[11] Patent Number: 4,472,271

[45] Date of Patent: Sep. 18, 1984

[54] FROTH FLOTATION APPARATUS AND PROCESS

[75] Inventor: Franklin C. Bacon, Jr., Macon, Ga.

[73] Assignee: Freeport Kaolin Company, New York, N.Y.

[21] Appl. No.: 411,587

[22] Filed: Aug. 25, 1982

[51] Int. Cl.[3] ..... B03D 1/14

[52] U.S. Cl. ..... 209/167; 209/5; 209/170

[58] Field of Search ..... 209/3, 5, 9, 10, 162–171; 210/197

[56] References Cited

U.S. PATENT DOCUMENTS

| | | | |
|---|---|---|---|
| 1,285,061 | 11/1918 | Daman . | |
| 1,367,332 | 2/1921 | Towne et al. | 209/170 |
| 1,646,019 | 10/1927 | Forrester . | |
| 2,778,499 | 1/1957 | Chamberlain et al. | 209/170 |
| 2,850,164 | 9/1958 | McCue | 209/171 |
| 3,437,203 | 4/1969 | Nakamura | 209/169 |
| 3,491,880 | 1/1970 | Reck | 209/164 |
| 3,503,499 | 3/1970 | Allegrini et al. | 209/5 |
| 3,525,437 | 8/1970 | Kaeding et al. | 210/221 |
| 3,701,421 | 10/1972 | Maxwell | 209/164 |
| 3,730,341 | 5/1973 | Mames et al. | 209/164 |
| 3,864,438 | 2/1975 | Nagahama | 261/87 |
| 3,872,010 | 3/1975 | Nagahama | 210/219 |
| 4,251,352 | 2/1981 | Shoemaker | 209/3 |
| 4,287,054 | 9/1981 | Hollingsworth | 209/170 |
| 4,339,042 | 7/1982 | Windle et al. | 209/5 |

FOREIGN PATENT DOCUMENTS

| | | | |
|---|---|---|---|
| 2371968 | 6/1978 | France | 209/170 |

*Primary Examiner*—Bernard Nozick

*Attorney, Agent, or Firm*—Fisher, Christen & Sabol

[57] ABSTRACT

A non-diluting flotation apparatus and process is disclosed which includes a single cell, or a series of multiple cells. Each cell comprises a non-agitated, flotation vessel having a submerged inlet in its upper portion for feeding a previously treated or conditioned clay or ore suspension in water. The suspension flows downward in the vessel to an outlet from which a combined product and recycle stream is taken. Thereafter, a recycle stream is separated and air bubbles are entrained into the recycle stream which is returned to the lower portion of the cell. In the cell the entrained air rises as very small bubbles, flushing certain mineral impurities removed from the clay with the air. The air and impurities form a froth atop the liquid surface and the froth is mechanically removed.

12 Claims, 2 Drawing Figures

FROTH FLOTATION APPARATUS AND PROCESS

BACKGROUND OF THE INVENTION

1. Field of the Invention

The present invention relates to apparatus for treating clays such as kaolin for the purpose of brightening the clay to render it more valuable and more particularly relates to froth flotation apparatus and method for treating aqueous clay slurries to remove titanium mineral impurities therefrom.

2. Prior Art

Froth flotation has been employed for decades for the purpose of removing impurities from ores and clays. A wide variety of flotation machines utilize violent agitation for the purpose of sucking air in from the atmosphere and distributing it throughout the pulp. The Denver Sub-A cell, the Fagergren flotation machine and the Agitair flotation machine typify this type of flotation equipment. These include an impeller located in the bottom, a pipe extending from the impeller upwardly to the atmosphere above the liquid level in the cell such that when the impeller rotates a suction is created for pulling air down through the pipe to the impeller which then distributes it in the form of bubbles throughout the pulp contained in the cell. Apparatus of this type cannot be utilized in a generally quiescent mode but depends upon the violent action of the impeller for bubble entrainment.

Illustrations of flotation apparatus in which air is introduced into the bottom of the cell without the use of a violent agitation caused by an impeller are given in U.S. Pat. Nos. 3,525,437, 3,730,341 and 4,287,054. In each of these illustrations however, diluting water containing entrained air bubbles is utilized to introduce air bubbles into the cell. Furthermore, none of these patents disclose the recycling of an unfloated fraction or the use of a recycled portion for carrying air bubbles into the pulp in the cell.

U.S. Pat. No. 3,701,421 utilizes an impeller 20 for agitating the pulp in a flotation cell and introduces air into the cell under the impeller so that the air is distributed by the impeller throughout the pulp. There is no disclosure or suggestion of recycling unfloated fractions removed from the lower portion of the cell and entraining air bubbles in the recycle portion.

The Steffensen flotation machine is extensively used and comprises an inverted cone-shaped cell into which the pulp is fed and into the narrow portion of which air is blown. U.S. Pat. No. 1,646,019 passes pulp through a trough into the bottom of which air is blown which forms a froth on the top of the pulp. The pulp travels in a generally horizontal direction while the air is being blown through it to provide a cross current type of flow rather than counter current flow. In addition, the apparatus of this patent and the Steffensen flotation apparatus fail to recycle an unfloated portion of the pulp after entraining air into said portion.

SUMMARY OF THE INVENTION

The purpose of this invention is to provide a frothing environment suitable to the fragile froths produced in weak chemical flotation systems. The device of this invention provides a positive counter current flow of the aerating stream and the feed stream. There is also a minimum of scouring at the bottom of the froth layer by turbulent currents as is normally the case in conventional flotation cells.

I have discovered a non-diluting flotation apparatus and method, which permits the extraction of selectively treated solid particles, e.g., conditioned $TiO_2$ discolorants, from higher than usual concentrations of fine minerals, e.g. kaolin clay, dispersed in water.

A major disadvantage of prior flotation processes is the necessity to dilute the liquid-solid mass to a consistency that the specially treated particles (e.g., conditioned $TiO_2$ discolorants) adhering to the gas bubbles will not be sheared off as they (the bubble and the attached solids) rise together through the liquid-solid mass.

In the flotation of hydrophilic minerals, such as, clays, dilution with water to such low concentrations as 5 (weight) % is not unusual. The resulting dilute pulp subsequently requires extensive dewatering to attain a useful concentration of product. Normally the flotation cells are top fed with ground minerals, some component of which tends to sink, other components of which will adhere to air bubbles made available by air entrained in a water stream introduced in the bottom of the cell.

The instant invention utilizes a cell in which recirculated liquid-solid mass is entrained with air bubbles and recirculated into the bottom of the cell. The bubbles generated sweep upward cleansing the counter current flow of new feed of those particles selectively treated to adhere to the bubbles (e.g., conditioned $TiO_2$ discolorant particles). The profusion and fineness of size of the bubbles produced in the liquid-solids mass sufficiently reduces the viscous drag of the pulp such that the selectively treated (conditioned) particles remain attached to the bubbles as they rise to the top of the cell where they are removed.

The present invention uses a single or a series of vertical, cylindrical vessel(s) of an appropriate depth and diameter, with feed, recycle, and product piping, a pump driven aeration system, and instrumentation to monitor various physical conditions in the system. When operated on a continuous basis, either singly, in parallel, or in series, the vessel's hydrophilic product (e.g., clay) is taken from the recycle stream. When operated on a batch basis, the contents of the vessel will be subjected to continuous frothing caused by recycling the contents and entraining air in the recycled contents.

Benefits of the above-described device and method include:

(a) Operation at higher concentrations than previously possible in the prior art, thereby reducing capital and operating costs for dewatering.

(b) Ease of control since the entire cell is operated as a unit.

(c) Flexibility to operate singly, or severally in series or parallel, to suit.

This invention relates to the treatment of fine clays or ores (i.e. materials consisting of particles smaller than 100 millimicrons) to remove certain equally (or smaller) sized contaminants.

More specifically, this invention concerns the treatment of kaolin clays to remove a substantial portion (e.g. 80% to 90% and more) of the discoloring titanium dioxide impurity. In one form of this treatment, crude kaolin may be dispersed into an aqueous suspension using any of several electrolytes (sodium silicates, tetrasodium pyrophosphate, etc.) or combination of electrolytes. This suspension is then passed through either 325 mesh sieves or solid bowl centrifuges, to remove oversize materials. The degritted crude slurry is then dosed with very low levels of certain proprietary reagents which have roles as activators or collectors, and then is subjected to intense scrubbing type agitation. Passing out of this conditioning phase, the slurry pH is adjusted with caustic and additional dispersant is added. The slurry passes next to the frothing cell, which is the subject of this invention.

The degritted crude slurry is then dosed with very low levels of certain proprietary reagents. When intimately mixed with the slurry by an intense, scrubbing type agitation, these reagents detach a substantial portion (e.g., 80% to 90% and more) of the titanium dioxide mineral impurity from the discrete kaolin particles. Certain other of these reagents affiliate themselves with the detached titanium dioxide contaminants to become carriers for the contaminant. The carrier, through some electrochemical differential facilitates the separation of the titanium dioxide from the kaolin slurry. In the prior art some form of froth flotation is used in which agitation and induced air produce an abundance of small air bubbles to which the carrier mounted contaminants attach and rise to the surfaces of the fluid mass for removal.

In the current process the severe agitation is limited in the froth vessel so that the currents of agitation do not disturb the rise of the contaminant laden bubbles nor scour the bottom of the froth interface (causing reentrainment of contaminants into the fluid mass). While this was not as severe a problem in previous flotation processes with chemically "strong" froths, it was a severe problem for chemically "weak" froths.

DETAILED DESCRIPTION OF THE INVENTION

Figure 1:
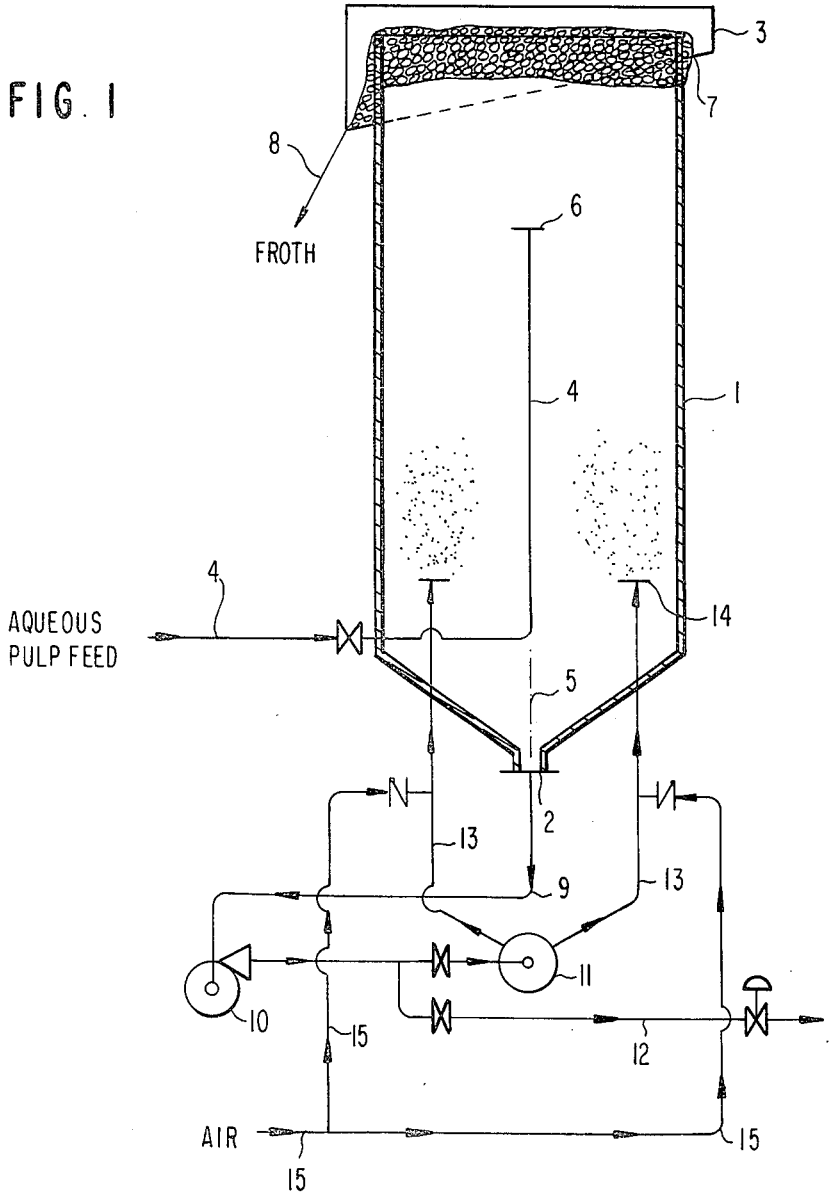
FIG. 1 is a diagrammatic sectional view through the vertical axis of one embodiment of flotation apparatus of the instant invention.

Referring to FIG. 1, there is shown a flotation vessel 1 having an outlet 2 in the bottom and a launder 3 at its top. The bottom of the vessel 1 is formed in a conical shape with the outlet 2 being positioned at the lowest point of the bottom of vessel 1. An aqueous pulp feed pipe 4 enters the lower sidewall of vessel 1 and extends to about the vertical axis of vessel 1 and then extends upwardly along the vertical center line 5 of vessel 1. The feed pipe 4 terminates in the upper portion of vessel 1 in a fountain of nozzles 6. The fountain of nozzles 6 in its simplest form comprises a cap on the upper end of pipe 4 which, for example, can be of 3" diameter and below the cap a series of twelve holes each drilled through the pipe 4 around its periphery; each series being spaced apart below the capped end of the pipe. The size of the holes should be large enough to permit sufficiently large throughput of aqueous pulp through the cell. As an illustration, holes of $\frac{5}{8}$" diameter have been found to be adequate.

The launder 3 is of conventional design and basically comprises an annular trough 7 extending around the upper end of the vessel 1. The bottom of the annular trough 7 is sealed to the outer surface of the sidewall of vessel 1 and, as shown in FIG. 1, the side wall of trough 7 extends higher than the top end of vessel 1. In practice, however, the upper lip of this annular trough or launder 7, need not extend as high as, and can indeed be lower than, the top end of vessel 1 and need only be high enough to contain and guide the froth to froth outlet 8. The bottom of the trough is slanted downwardly from a point just below the top of vessel 1 and a froth outlet 8 is provided at the lowest point of the bottom of trough 7. The froth formed in vessel 1 overflows the upper end of said vessel into the trough 7 and flows down the bottom of said trough to the froth outlet 8. If desired, a water spray can be directed into the trough to facilitate movement of the froth down to and through outlet 8.

Aqueous pulp is discharged through outlet 2 and passed through discharge conduit 9 and is pumped by pump 10 to a distribution manifold 11 and a product pipe 12. Thus, a portion of the discharged aqueous pulp is passed through product pipe 12 to further product treatment or to subsequent flotation cells. The remaining portion is sent to distribution manifold 11 from which it is distributed through risers 13 which enter the vessel 1 through its bottom and extend upwardly to a point above the point at which the feed pipe 4 enters. At the top of each riser is provided a nozzle 14 opening into the bottom of vessel 1. Air is passed through air lines 15 to each riser and a suitable device for injecting the air into the aqueous pulp flowing within the risers is provided so that air is intimately mixed with the aqueous pulp feed before it enters the vessel 1. For example, a water jet eductor similar to a laboratory aspirator used for generating low volume vacuum can be used.

Figure 2:
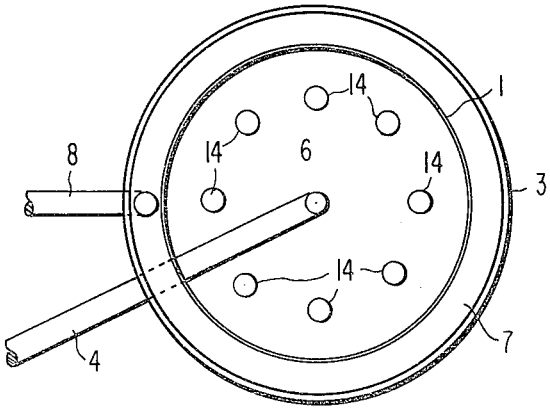
FIG. 2 is a plan view of the apparatus.

In the followiing description of the embodiment shown in FIGS. 1 and 2 of this invention, the vessel 1 is filled to its operating level with a properly conditioned water suspension of a fine particle sized mineral, such as clay. In operation, the properly conditioned water suspension, e.g., aqueous clay pulp, continuously enters the system through feed pipe 4 and fountain of nozzles 6. Simultaneously, aqueous clay pulp is discharged through conduit 9 and a major portion of it is returned through risers 13 and nozzles 14. Air is intimately mixed with the recycled portion of aqueous clay pulp passing through risers 13. Upon entering the vessel 1, the air-aqueous clay pulp mixture forms extremely fine bubbles, e.g., on the order of about 200 microns. Micells of air and conditioned mineral impurity in the aqueous pulp, e.g., conditioned titanium dioxide particles in an aqueous clay pulp, form and migrate upwardly to the surface to the top of vessel 1. As these micells rise to the surface they expand under the diminishing pressure. The mineral values in the water suspension drain from the surface of the bubbles or micells and from the interstices of the froth formed from the expanded micells. The froth becomes relatively stable as it rises and is buoyed by new micells rising from the risers 13 and nozzles 14.

The incoming aqueous pulp feed through pipe 4 and nozzles 6 enters near the upper portions of the vessel 1. The mineral particles contained in the aqueous pulp feed settle downwardly through a rising stream of very fine air bubbles. In this manner, conditioned titanium dioxide impurity particles are given innumerable opportunities to become affiliated with air bubbles and so to be carried upwardly to the froth layer at the top of vessel 1 for eventual extraction. By this manner of introducing the feed into the vessel, a substantial volume of aqueous pulp feed can be released into the vessel without creating currents or agitation which could disturb the bottom of the froth layer at the top of the tank which could possibly cause impurity particles carried by the froth to be scoured from the bottom layers of the froth and reentrained in the pulp.

In the case of removing conditioned titanium dioxide impurity particles from clay pulp, such as kaolin clay pulp, the froth is a light to medium shade of reddish brown with sufficient mechanical strength to stand as high as 4 to 5 inches unsupported without slumping. In order to facilitate the rising and drainage of new micells, the froth can be swept from atop the vessel into the launder 3 by means of a slowly rotating rake, for example rotating at 1 to 2 rpm.

This invention differs significantly from the prior art devices. Although it generally performs a similar froth flotation function, it does so for a much more fragile, chemical froth. The traditional multicell flotation cells used for purifying kaolin, talc, calcium carbonate and other fine minerals rely on a high speed impeller in each cell to mix the air drawn, or fan-forced, into the impeller's suction into the fluid suspension in the cell. The turbulence created by such impellers normally might not be objectionable in froth systems made stronger by the use of relatively high amounts of conditioning chemicals. However, such turbulence is detrimental in weak froth systems which utilize relatively low amounts of conditioning chemicals and retard the cleansing of the aqueous pulp suspension. Furthermore, the micells formed in the apparatus of the present invention are more numerous and significantly finer than the micells generated by the above mentioned prior art flotation cells.

The non-diluting flotation device described above, and method for its application, permits the extraction of selectively-treated (to be hydrophobic), very fine (LTN 10 micrometers, ESD) mineral impurity paticles from higher than normal concentrations of an equally fine mineral dispersed in water. A significant disadvantage of the prior art in the flotation of such minerals is the frequent necessity to dilute the mineral concentration with water to as low as 5% (by weight). The resulting dilute pulp requires extensive capital and operating expense for dewatering to a useful concentration of product. In this invention, the mineral pulp can be maintained at a concentration in excess of 35% solids, a large reduction in water content from the 10%–13% solids used in typical, fine-mineral flotation. If desired, the cell of this invention can be operated at lower concentrations than 35% solids, and at concentrations as high as 45% solids (in kaolin flotation).

The method of this invention is performed in the specially designed vessel described and claimed herein. Said vessel would normally be a vertical, cylindrical tube or tank with at least 3.6 meters (12 feet) of active height. The cross-section could be other than round. The volume of the vessel is a function of the desired residence time and flow rates required in a particular application. Admission of fresh feed to the vessel is through a fountain of nozzles located at an elevation ca. 0.6 meters (2 feet) below the top of the tank.

The means of continuous withdrawal of the mineral pulp from the vessel is provided at the bottom of the vessel. A pump provides flow which can be divided by means of properly arranged valves to divert some of the exiting mineral pulp to other points. However, the major portion of the flow (ca. 8% of the vessel's volume, per minute) is returned to the vessel through radial nozzles located on 40° centers on a circumference, the radius of which is $\frac{2}{3}$'s that of the vessel. These nozzles discharge at an elevation ca. 0.9 M above the bottom of the vessel. As the mineral pulp travels through the risers to the nozzles, moderate pressure (e.g. 30 PSIG) air is injected at a rate of 0.5–2.5 $M^3$/sec (1–5 ACFM). This air is intimately mixed (by action through the nozzle) with the mineral pulp, so that when released into the vessel the air creates an abundance of very small (LTN 100 micrometers) bubbles to which the hydrophobic mineral particles attached themselves. These hydrophobic mineral-laden bubbles rise to the liquid surface where they overflow the vessel into a circumferential launder. The extracted material in the launder will be greatly concentrated (relative to its previous concentration in the hydrophilic mineral pulp) and can be either reprocessed to recover mineral values or discarded.

EXAMPLE

On a production scale, a slurry of clay mined in the Sandersville area of Georgia and having a particle size range of 50 to 65% less than 2 μm was treated with 1 to 3 ppt sodium silicate dispersing agent. The designation ppt means pounds of reagent, e.g. sodium silicate, per ton of clay solids. The resulting material was passed through a 250 mesh screen to remove mica, sand and other coarse particles. The screened slurry is then combined with 1 ppt Oxone (potassium persulfate) and its pH is adjusted to 6.5 to 7.0 with aqueous sodium hydroxide. The resulting slurry is allowed to stand for at least 15 hours, e.g. 15 to 24 hours, to allow the Oxone to operate on oxidizable material in the slurry. At the end of the Oxone treatment the pH of the slurry is about 6.5 to 6.8.

The slurry is heated to about 80° to 100° F. and 0.25 to 1.0 ppt of calcium chloride is added as a 20% aqueous solution. The resulting slurry mixture is pumped into the first of a series of five conditioners having the construction described and claimed in copending application Ser. No. 411,505 filed concurrently herewith entitled "High Intensity Conditioning Mill and Method", F. C. Bacon, Jr. and R. L. Brooks. Oleic acid in the amount of 1.5 to 2.5 ppt is added to the slurry in the first conditioner and conditioning is conducted with a total residence time of 50 to 120 minutes in the series of five conditioners. The flow rate is so adjusted that the slurry passes out of the fifth conditioner within 50 to 120 minutes after it passes into the first conditioner.

After removal from the fifth conditioner the slurry is mixed with 2.5 to 4 ppt of sodium polyacrylate and then pumped into the first of five froth flotation tanks. The pH of the slurry at this point is in the range of 5.5 to 6.5 and its temperature is about 160° to 180° F. The froth flotation tanks are of the type described herein. The residence time of the slurry in passing through the series of froth tanks is 3 to 5 hours which is the time elapsed from the point the slurry enters the first flotation tank until the clay product slurry exits from the fourth flotation tank. The froth from the first tank is discarded. The product recovered from the bottom of the first flotation tank is fed as feed into the second tank and enough sodium hydroxide is added to raise the pH into the range of 7.2 to 9.0. The pH in this range improves the froth stability since the froth tends to be more unstable at the lower pH, although in the first tank there are larger quantities of activator and conditioner to offset the foam instability due to acid pH. In addition, the alkaline pH in the second tank assists in removing the oleic acid. The product from the second tank passes successively into the third and fourth flotation tanks and the product from the fourth tank is passed to product storge or further treatment and improves the purified clay product from which titanium mineral discoloring impurities have been removed. The froths floated off of the second, third and fourth tanks are combined and fed into the fifth flotation tank. These froths were previously watered in the launders of the respective second, third and fourth tanks so that they are dilute slurries. The froth from the fifth flotation tank is discarded and the product from the fifth flotation tank is recycled into the second froth flotation tank.

What is claimed is:

1. Apparatus for separation of a floated fraction and an unfloated fraction from an aqueous mineral pulp containing a mixture of particles of both said fractions by froth flotation comprising:

a flotation chamber adapted to contain a relatively quiescent body of said aqueous pulp;

pulp feed pipe extending within the upper portion of said flotation chamber for introducing aqueous pulp into said flotation chamber;

froth overflow means disposed adjacent the upper end of the flotation chamber for discharging therefrom said floated fraction containing floated particles of said aqueous pulp;

an outlet in the lower portion of said flotation chamber for discharging said unfloated fraction of said aqueous pulp;

means including pulp recycle pipe extending within the lower portion of said flotation chamber between said feed pipe and said outlet for recycling at least a portion of said unfloated fraction back into the lower portion of said flotation chamber above said outlet; and means for introducing a multitude of air bubbles into said recycled portion of said unfloated fraction before it is released into said chamber.

2. Apparatus as claimed in claim 1 wherein said outlet is at the bottom of said flotation chamber and said pulp feed means introduces aqueous pulp into the upper portion of said flotation chamber.

3. Apparatus as claimed in claim 1 wherein said recycling means includes a plurality of distribution nozzles located at generally, horizontally spaced apart positions in the lower portion of and above the bottom of said flotation chamber and through which nozzles said unfloated fraction discharged through said outlet is released into said chamber.

4. Apparatus as claimed in claim 3 wherein said pulp feed means includes a conduit that enters said flotation chamber below said distribution nozzles and extends generally vertically to the upper portion of said chamber and above said distribution nozzles.

5. Apparatus as claimed in claim 4 wherein said pulp feed conduit extends upwardly generally on the vertical center line of said flotation chamber.

6. Apparatus as claimed in claim 5 wherein said distribution nozzles are located on different radius lines and at generally the same distance from the vertical center line of said flotation chamber.

7. Apparatus as claimed in claim 6 wherein means are provided for withdrawing from said apparatus the remainder of the unfloated fraction remaining after recycling said portion thereof back into said chamber.

8. Apparatus as claimed in claim 7 wherein said recycling means includes a recycle manifold and a plurality of pipes connecting each of said distribution nozzles to said manifold, said pipes entering said chamber through the bottom thereof and extending generally vertically upward to discharge into the lower portion of said flotation chamber.

9. Apparatus as claimed in claim 8 wherein said pipes are equipped with means for entraining air into the recycled unfloated fraction passing through said pipes.

10. A method of treating kaolinitic clay to remove therefrom titanium mineral impurities, said method comprising the steps of:

(a) mixing said clay in the form of an aqueous slurry having a solids content of clay of at least 25% by weight with an activator for the titanium mineral impurities comprising a water soluble salt of a metal chosen from alkaline earth metals and the heavy metals and a collector for the titanium mineral impurities;

(b) conditioning the aqueous clay slurry at a solids content of at least 25% by weight for a time sufficient to disperse therein at least 25 horsepower hours of energy per ton of solids;

(c) maintaining a body of the conditioned aqueous pulp in a relatively quiescent condition in a flotation chamber;

(d) removing an unfloated fraction of said aqueous pulp from the lower portion of said body;

(e) recycling at least a portion of said unfloated fraction back into the lower portion of said body of aqueous pulp through a recycle feed pipe extending within said flotation chamber;

(f) entraining a multitude of air bubbles into said recycled unfloated fraction before it is released in said body of aqueous pulp, said air bubbles causing a froth containing said titanium mineral impurities to form on the surface of the aqueous pulp body;

(g) removing said froth containing the titanium mineral impurities from said aqueous pulp body; and (h) feeding additional conditioned aqueous pulp through a feed pipe extending within the upper portion of said body of conditioned aqueous pulp in said flotation chamber above said recycle feed pipe such that there is a general downward flow of aqueous conditioned pulp and general upward flow of air bubbles.

11. Method as claimed in claim 10 wherein said aqueous pulp is fed to said flotation chamber through a conduit entering the lower portion of said chamber and extending to the general vertical center line of said chamber and thence extending vertically to a discharge end in the upper portion of said chamber and said recycling means includes a plurality of pipes extending generally vertically through the bottom of said chamber to a point higher than the conduit portion extending to the center line and a distribution nozzle at the upper end of each pipe through which the recycled unfloated fraction containing air bubbles is introduced into the chamber, whereby the air bubbles and hydrophobic titanium mineral impurities carried thereby are generally unobstructed in traveling upwardly in said chamber.

12. Method as claimed in claim 11 wherein said unfloated fraction of said aqueous pulp is discharged from said chamber at a point lower than said distribution nozzles.

* * * * *